US006450816B1

(12) United States Patent
Gerber

(10) Patent No.: US 6,450,816 B1
(45) **Date of Patent: *Sep. 17, 2002**

(54) IDENTIFICATION SYSTEM

(75) Inventor: Peter Gerber, Berikon (CH)

(73) Assignee: Oerlikon Contraves AG, Zurich (CH)

( * ) Notice: Subject to any disclaimer, the term of this patent is extended or adjusted under 35 U.S.C. 154(b) by 0 days.

This patent is subject to a terminal disclaimer.

(21) Appl. No.: 09/099,837

(22) Filed: Jun. 18, 1998

(30) Foreign Application Priority Data

Mar. 9, 1998 (CH) ..... 0553/98

(51) Int. Cl.[7] ..... F41A 33/00; F41G 3/26

(52) U.S. Cl. ..... 434/11; 434/19; 434/21; 434/22

(58) Field of Search ..... 434/11, 16, 19, 434/21, 22

(56) References Cited

U.S. PATENT DOCUMENTS

| | | | | |
|---|---|---|---|---|
| 4,194,201 A | 3/1980 | Stein | 342/45 |
| 4,837,575 A | 6/1989 | Conner, Jr. | 342/45 |
| 5,479,408 A | 12/1995 | Will | 370/313 |

FOREIGN PATENT DOCUMENTS

| | | |
|---|---|---|
| DE | 4003960 A1 | 8/1990 |
| EP | 0 795 733 A3 | 9/1997 |
| EP | 0 836 068 A1 | 4/1998 |
| EP | 0 836 069 A1 | 4/1998 |
| EP | 0 859 243 A1 | 8/1998 |
| FR | 2 659 136 | 9/1991 |

*Primary Examiner*—John Edmund Rovnak
(74) *Attorney, Agent, or Firm*—Townsend and Townsend and Crew LLP; Guy W. Chambers

(57) ABSTRACT

A soldier (A) carries a weapon, on which a laser device (1) is mounted, which is used for illuminating a harness device (6) on the body of another soldier (B). The laser device and the target device each include a microprocessor as well as an ultrasound unit and/or a radio unit (72, 71) such that, if the laser device does not receive a response from the target device within a period of time Ta following the transmission of a bundled, coded laser beam, it transmits another laser beam with different coding, which causes the ultrasound unit and/or the radio unit of the target device to transmit an acknowledgement which can be received by the ultrasound unit and/or the radio unit of the laser device.

14 Claims, 12 Drawing Sheets

IDENTIFICATION SYSTEM

FIELD OF THE INVENTION

The invention relates to an identification system with at least one laser device for identifying at least one target device or an object, wherein the laser device is designed to emit a coded laser beam, and wherein the target device or the object have sensor means for detecting this laser beam and converting it into electrical signals, which are supplied to a discriminator, and also have transmitting means for returning reports to a receiving means in accordance with decisions made in the discriminator, wherein the receiving means are located inside or outside of the laser device. The invention further relates to a target device for said identification system, and to a method for operating said identification system.

BACKGROUND OF THE INVENTION

In accordance with the present invention, "friendly" soldiers carry a system device in accordance with the invention, which is mounted on a weapon for illuminating a target, and on their bodies have a harness which in the concept of the invention is associated with the system device, which in accordance with arbitrary simulation scenarios, exercise detection functions for various applications during training and in combat, wherein such a system device can consist of portions of the subjects of parallel patent applications of Applicant EP-97 120818.6, EP-97 202141.4, EP-97 113661.9 and EP-97 109111.1.

OBJECT AND SUMMARY OF THE INVENTION

It is now the object of the invention to create an improved identification system in order to achieve simple and particularly dependable data transmission in the course of identification functions.

A soldier (A) carries a weapon, on which as laser device (1) is mounted, which is used for illuminating a harness device (6) on the body of another soldier (B). The laser device and the target device each include a microprocessor as well as an ultrasound unit and/or a radio unit (72, 71) such that, if the laser device does not receive a response from the target device within a period of time Ta following the transmission of a bundled, coded laser beam, it transmits another laser beam with different coding, which causes the ultrasound unit and/or the radio unit of the target device to transmit an acknowledgment which can be received by the ultrasound unit and/or the radio unit of the laser device.

The invention will now be explained in detail by way of example, making reference to the drawings.

DETAILED DESCRIPTION

Figure 1:
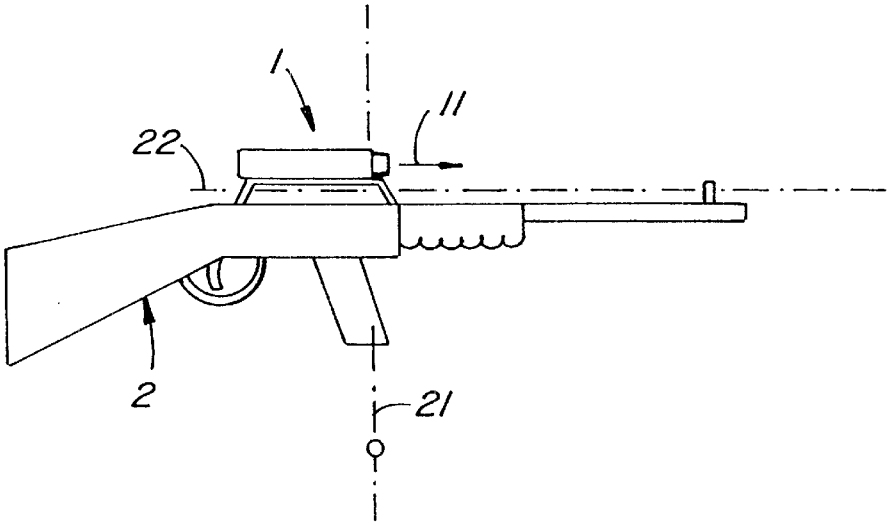
FIG. 1 represents a system device in accordance with the invention mounted on a weapon.

FIG. 1 shows that an identification system laser device 1 in accordance with the invention is mounted on a weapon 2 in such a way that the center of gravity line 21 of the weapon equipped with the laser device 1 intersects the laser device 1 itself. As can be seen from FIG. 2, the laser device 1 (FIG. 1) comprises a laser target illumination element 3, a housing element 4 in which the batteries required for operation are housed, among other things, and a mounting rail 5, which constitutes the interface of the weapon. The elements 3 and 4 have partially cylindrical sections extending parallel in such a way that a soldier can aim along an aiming line 22 (FIG. 1) between them. A front face of the element 3 has a display window 31 in the manner of a miniature screen, which is used for the reproduction of different pictograms regarding important information. The housing element 4 is provided with an illuminated spot 41, an illumination zone 42, a fastening aid 43 for an antenna, two coaxial connectors 44, one operating knob 45, 46 each and a switch 47.

Figure 2:
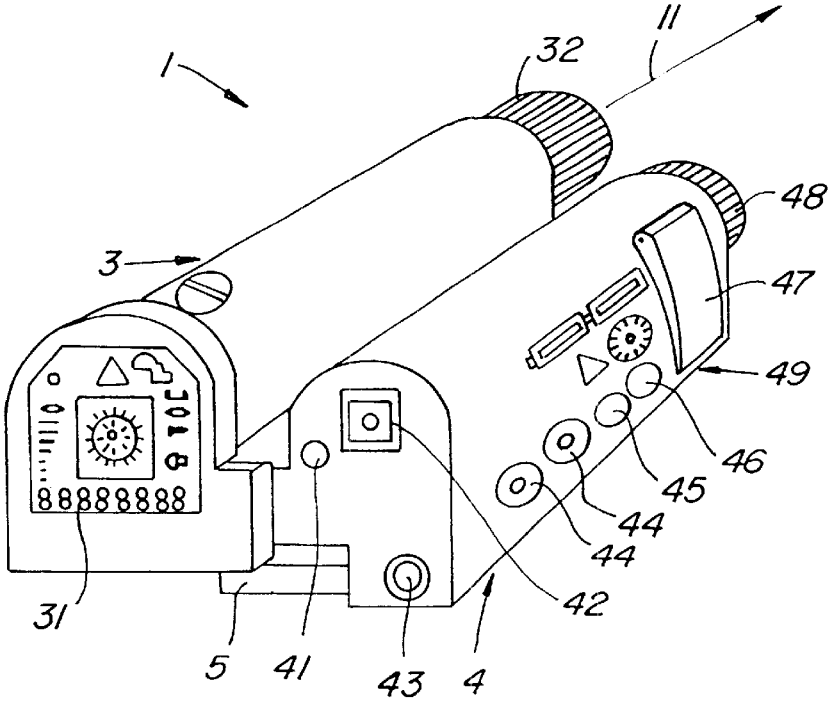
FIG. 2 is a rear view of the system device in accordance with FIG. 1.
Figure 3:
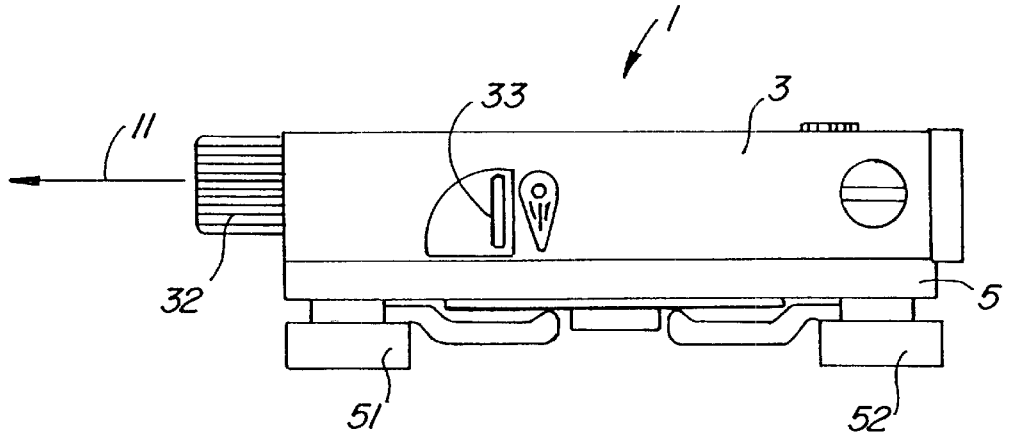
FIG. 3 is a left view of the system device in accordance with FIG. 1.

It can be seen from FIGS. 2 and 3, that the front part of the element 3 has an optical laser device 32, which can emit a laser beam 11. As represented in FIG. 3, the mounting rail 5 can be provided with widenings 51, 52, which make mounting of the device 1 on the weapon 2 easier. A lateral lever 33 can be provided on the element 3 in order to cause a change in the laser beam characteristics by the insertion of a small hologram plate, so that at the target the beam diameter is increased in a ring shape, planar shape or by points distributed in a ring shape.

Figure 4:
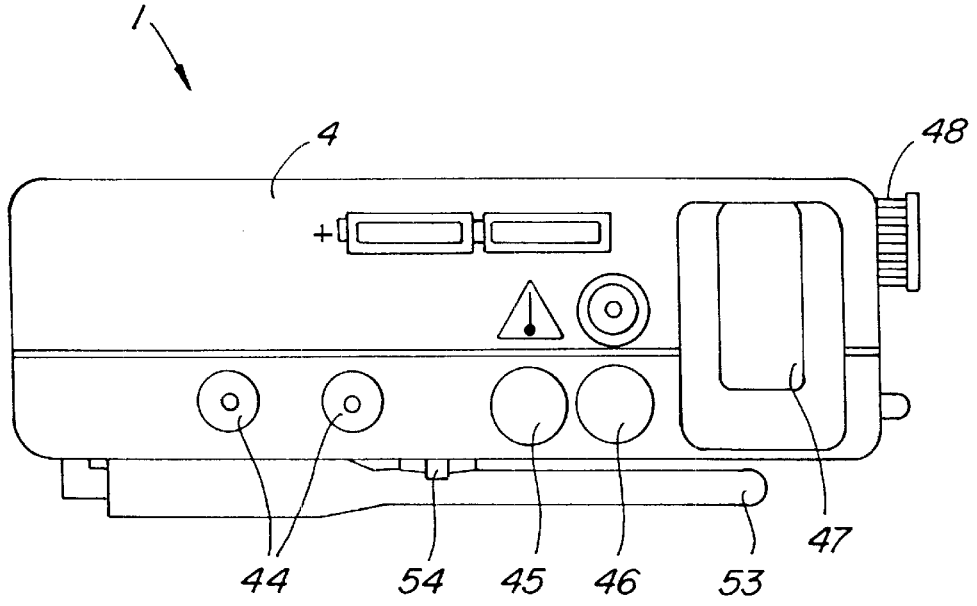
FIG. 4 is a right view of the system device in accordance with FIG. 1.

FIG. 4 shows a housing element 4 with a pivotable rod antenna 53 and with a snap-on or fixation device 54 for this antenna 53. An optical receiving device 48 can be provided on the front face of the housing element 4.

Figure 5:
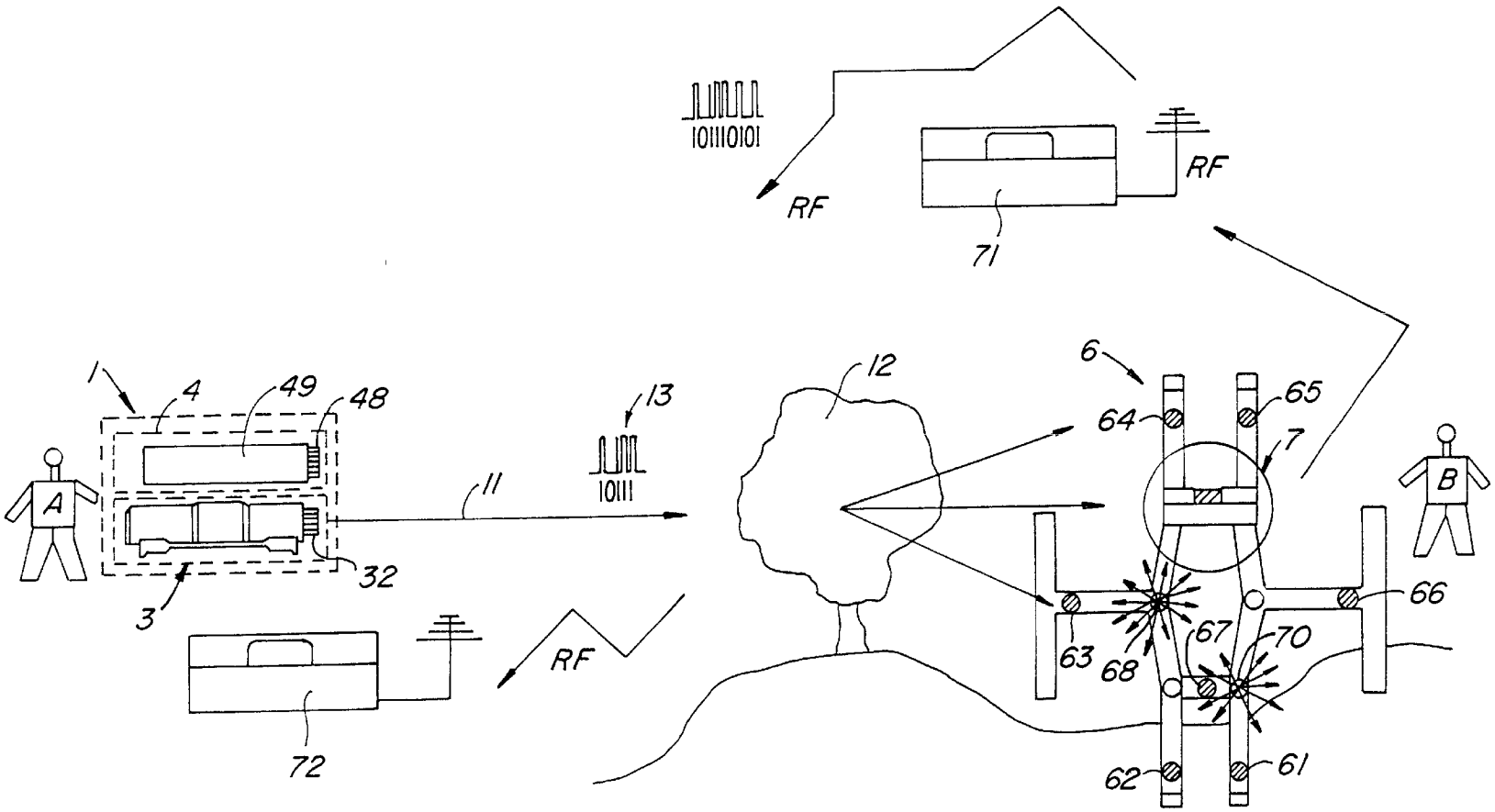
FIG. 5 is a schematic representation for explaining the mode of operation of a harness, equipped with sensors, of the identification system in accordance with the invention, in particular in case of a partially hidden target.

FIG. 5 represents a harness 6 provided as equipment for soldiers for combat purposes, having a multitude of electrical, or respectively electronic components. A harness of this type is known, for example, from German Application DE-OS 40 03 960 A1. However, the harness 6 in FIG. 5 supports sensors 61, 62, 63, 64, 65, 66, 67, which are preferably equipped with a special electronic circuit. In addition, this harness supports one or several LED transmitters 68, 70, as well as a GPS and a control unit 7, if required with a battery. In the example in accordance with FIG. 5 there is an obstacle, for example a bush 12, between the laser target illumination element 3 in the weapon of a first soldier A and the harness of a second soldier B.

Figure 6:
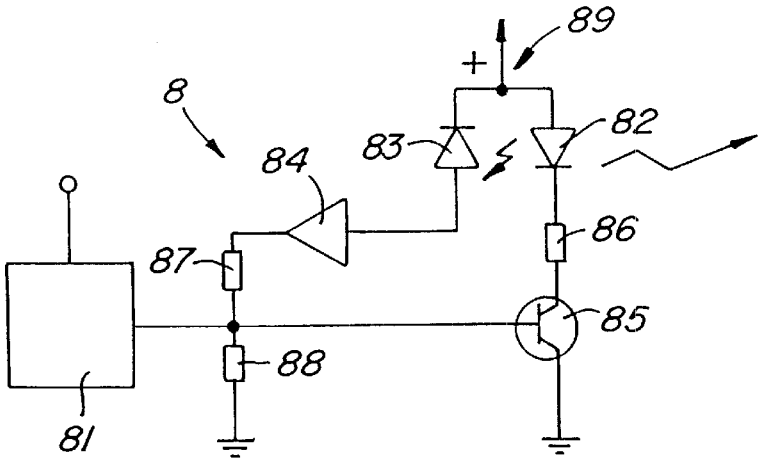
FIG. 6 is a schematic representation of the electronic triggering of a preferred low-voltage CW laser, in particular for use in a laser target illumination element of the system device in accordance with the invention.

The pulsed CW laser 8 in FIG. 6 is connected to a modulator 81 and comprises, for example, a laser diode 82, a feedback diode 83 coupled with it, an operational amplifier 84 and a transistor 85, as well as several resistors 86, 87 and 88. The anode of the diode 82 and the cathode of the diode 83 are together connected to a voltage source 89 (positive pole), for example a 3 to 5 Volt battery. The cathode of the diode 82 is connected via the series connection of a resistor 86 and the emitter-collector path of the transistor 85 with ground (negative pole). The amplifier 84 with the resistor 87 connected downstream of it has been inserted between the anode of the diode 83 and the base of the transistor 85. The base of the transistor 85, which constitutes the modulation input of the circuit, is connected with ground via the resistor 88. A reference potential can of course also serve as ground. The modulator comprises a circuit 81, which not only performs a coding function, but also a chopper function, in order to chop a light signal of the (carrier) frequency ft already prior to coding, which takes place at a bit rate of the frequency fd, with a chopper frequency fz.

Figure 7:
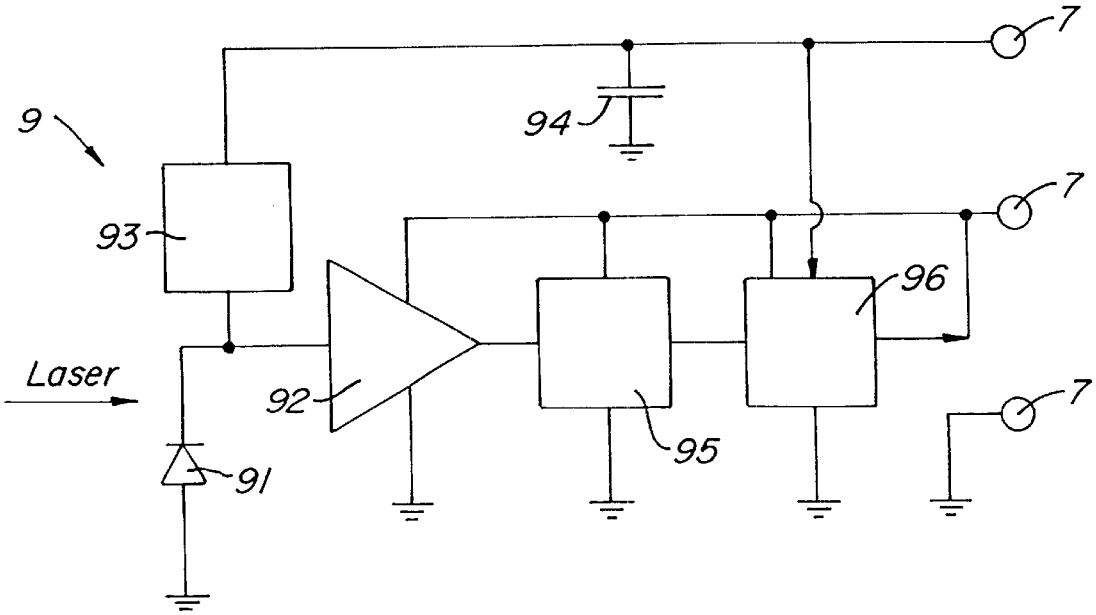
FIG. 7 is a block diagram of a sensor circuit for the sensors of such a harness.

The sensors 61 to 67 in FIG. 5 contain a sensor circuit 9 in accordance with FIG. 7. The circuit 9 includes, for example, a detector diode 91, one side of whose cathode is connected with the input of an amplifier 92 and the other side via a coil 93 with a connector of a capacitor 94. The output of the amplifier 92 is connected via an integrator filter 95 to a microprocessor 96, whose output signals are transmitted via cables to the control unit 7.

The friend-or-foe identification system in accordance with the present invention operates under two different environmental conditions, depending on whether the soldier intended as a target is on open ground or under cover. If, in a scenario with open ground, a soldier A wants to identify a soldier B, who is not under cover (this would be without the bush 12 in FIG. 5), he puts the laser target illumination device 1 mounted on the weapon into operation and "fires" a laser beam 11 from the laser target illumination device 1 at soldier B. A coded message 13, conveyed by the laser beam 11, requests soldier B to identify himself. A harness 6 of soldier B receives the coded message 13, which is composed, for example, of a signal from soldier A containing 116 bits. A sensor, for example 63 on the harness 6 of soldier B, recognizes the 116 bit signal, which is composed as follows: number of the soldier/security code/GPS data, if required,/form of the response. Soldier B will now receive the coordinates of soldier A, and an LED transmitter 68 on the harness 6 of soldier B transmits an acknowledgement code. The acknowledgement code can be arbitrarily selected by the unit operating the system. For example, it can consist of the name of soldier B, or of the battalion, the position (GPS coordinates) or arbitrary other terms.

In accordance with an embodiment of the invention, soldier A is not only equipped with a laser transmitter 3, but also has a laser receiver, possibly housed in the element 4, with an optical receiving device 48, which is mounted parallel with the laser transmitter, i.e. with the element 3. The laser receiver only receives diffused light, transmitted by the LED transmitter 68 or 70 of soldier B. Soldier A transmits an identification code until he receives an acknowledgement from soldier B. If soldier B is a member of his own party, soldier A see a red alert signal in the illuminated spot 41 and/or the illuminated zone 42, which prohibits him from attacking soldier B. This alert signal appears in the system in such a way that it can only be viewed by soldier A and not by the enemy.

Although soldier A receives the acknowledgement signal via the optical receiver device 48 in the LED receiver 49 of his devices 1, for example, a corresponding target illumination device 3 of the laser device 1 is not used as an infrared transmitter by soldier B for returning the acknowledgement signal to soldier A, because the laser target illumination device 3 transmits a lightbeam which is too tightly bundled. This lightbeam, which is preferably narrowly aligned at an angle of approximately 0.5 mrad, could not return the acknowledgement signal to soldier A, since soldier B does not necessarily known the position of soldier A. For this reason a high output LED transmitter 68/70 (LED=Light Emitting Diode), which is also attached to the harness 6 of soldier B, is used for returning the acknowledgement code. This LED transmitter 68/70 radiates its light output over a much greater spatial angle, so that the acknowledgement by soldier B can be received by soldier A under all circumstances. As long as soldier A can see soldier B, he is in a position to receive the acknowledgement signal.

Since combat increasingly takes place under poor light conditions, it is becoming more and more common to equip soldiers involved in combat with night vision goggles. To the extent that this is the case, the soldier usually carries the weapon at the hip. The observation and aiming process takes place along the laser beam 11, which is visible by means of the night vision goggles (not represented). Because of the position of the weapon 2 at the hip, the red alert signal (41 and/or 42) is not visible to the soldier carrying the weapon 2. However, since the laser target illumination device 3 is controlled by a microprocessor, it is possible to alternatingly switch the laser beam 11 on and off in place of or in addition to the red alert signal. The soldier, equipped with night vision goggles, can detect the alert signal swiftly and easily by means of the laser beam and in this way can identify the soldier illuminated in this way as being of his own party.

If the illuminated soldier is under cover, for example concealed behind a bush 12, soldier A can see soldier B's body only partially. Soldier A again fires the laser beam 11, as described above. The harness 6 of soldier B will nevertheless detect the laser beam from soldier A, since the entire system is sufficiently sensitive to this type of application, for example because each of the sensors 61, 62, 63, . . . is equipped with a special electronic device, which can be supplied by a common battery or, if desired, also be one small battery for each. The main problem lies in that the LED transmitter 68 of soldier B is completely screened by the bush 12, and soldier A does not receive the answer from soldier B. Only light directly coming from the LED transmitter 68/70 can be received by soldier A, since the light is beamed out diffusedly and not directed. If within a period of time Ta of, for example, 100 ms after the laser beam was transmitted, soldier A does not receive an acknowledgement, but soldier B would obviously be able to receive information from soldier A, soldier B is given a second chance in that a pulse sequence is transmitted as acknowledgement via a radio unit 71 disposed on the harness 71, which can include a radio transmitter or a radio transmitter/receiver. This radio signal can be received by soldier A under all conceivable circumstances, but should only be used in case all other means fail, because of its vulnerability to enemy defense measures. By means of transmitting such radio signals, enemy forces could also cause friendly soldiers to be pursued or not identified. If soldier B is an enemy, no response to the interrogation transmitted by the coded lightbeam from soldier A in both scenarios described above takes place.

The laser transmitter 3 of soldier A will cease operating after a time period Tb, and a radio unit 72 installed in the system and equipped with an antenna 53 will transmit a pulse sequence which, for example, is Tc=1 ms long for security reasons, for identification interrogation. The length of time Tb can be between 1 ms and 1 s, for example, but preferably be 100 ms, and for this pulse sequence Tc can be selected to be equal to or greater than 0.1 ms, preferably approximately 1 ms or longer. The radio unit 72 can also comprise a radio transmitter or a radio transmitter/receiver. This pulse sequence can be received under all conceivable conditions over a distance of several kilometers. If no response is received over a radio channel after this second transmission, the system will identify the illuminated target as an enemy object. A total time of 200 ms is required overall for this process. If soldier A wears night vision goggles, he will observe the continuously transmitted laser beam, which identifies an illuminated soldiers as an enemy, through the night vision goggles.

Figure 9:
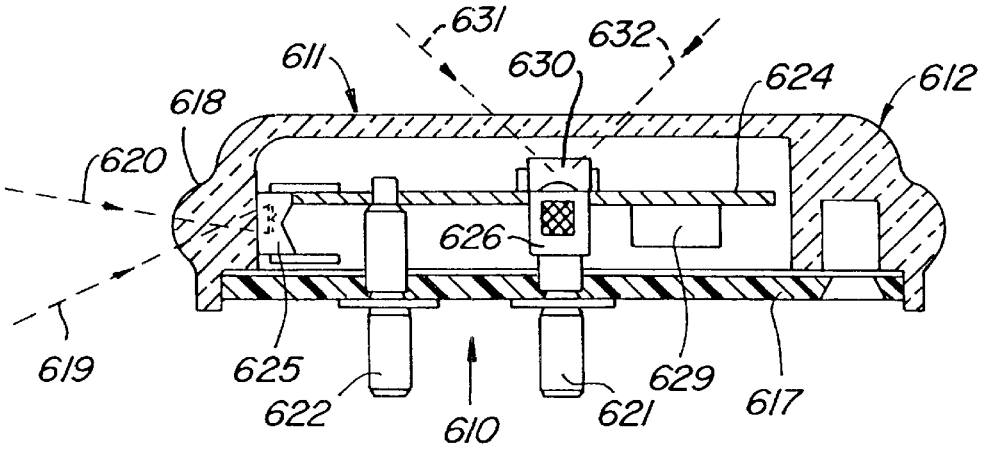
FIG. 9 is a section along the line IX—IX in FIG. 8.

The sensors 61, 62, 63, . . . are preferably embodied in the form of round disks of such a relatively great thickness that they are sensitive to laser beams not only on the surface, but also laterally, i.e. at the periphery of the disk. This means that the detector 91 (FIG. 7) is also distributed in an appropriate shape over the cylindrical surface of the disks (FIG. 9). As mentioned above, the laser beam is chopped, so that the detector 91 detects an intermittent beam, which it converts into an a.c. current of the same frequency fz with the aid of the resonance circuit constituted by the coil 93 and the capacitor 94. The a.c. voltage at the input of the amplifier 92 resulting from this is very greatly amplified by the latter. The output signal of the amplifier 92 is supplied to the integrator filter 95, which provides the coded signal to the microprocessor 96 for evaluation. The signals evaluated from this are then provided to the control unit 7 by the microprocessor 96. The pulse width of the radiated chopped laser pulses lies, for example, between 10 ns and 100 ms, and preferably between 0.1 and 10 ms. The width of the information bit pulses preferably corresponds to the width of a number of 3 to 50 chopped laser pulses.

In accordance with another embodiment of the invention, instead of one of the operating knobs 45 or 46 (FIG. 2), a lever 47 (flipped up) can also be used for triggering the laser device.

The upper portion of the laser device is preferably constituted of two semicylindrical, parallel chambers, wherein the gap present between these chambers permits an unhindered view of the target. Since this gap is wide enough, it is possible in another embodiment of the invention to apply an illuminated spot just at the side of this gap, preferably in the end area of the gap, where the lightbeam is radiated, in such a way that the soldier can simultaneously see the target and this illuminated spot. The laser beam preferably emits light of a wavelength in the range between 780 and 1000 nm, for example 820 nm, for example with an output on the order of 50 mW.

Figure 8:
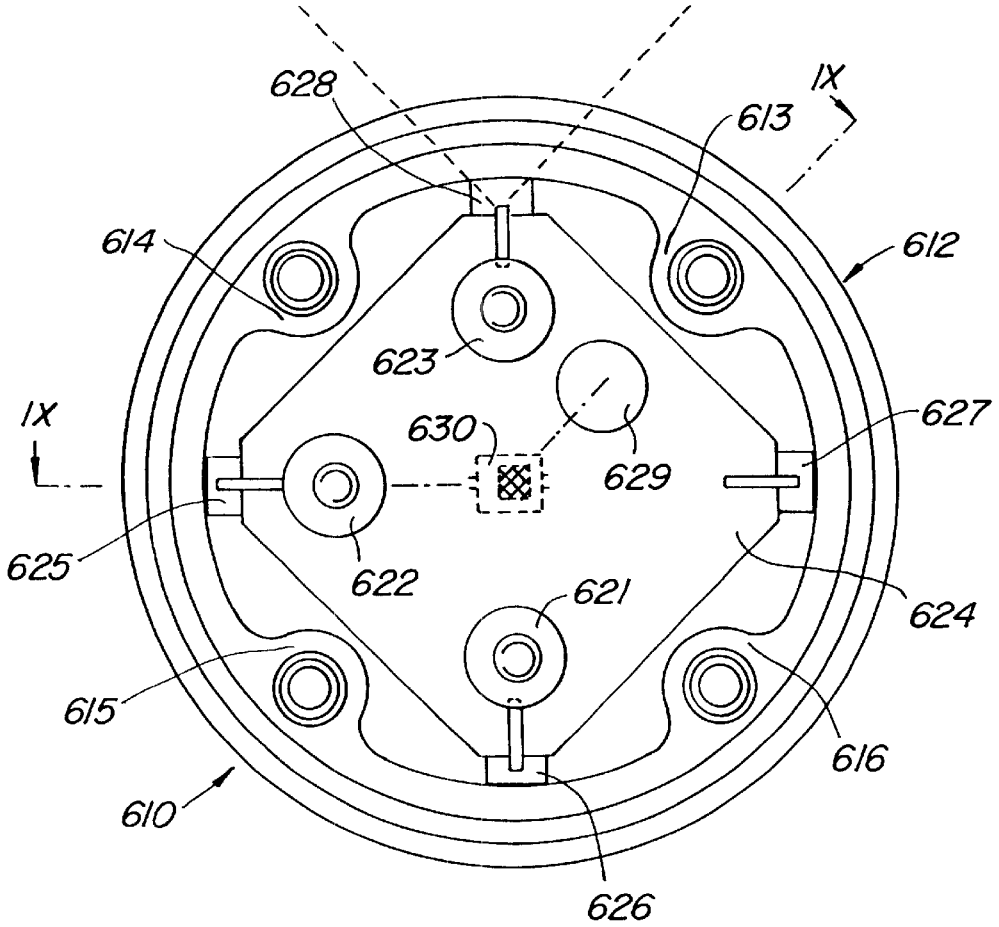
FIG. 8 shows the interior area of a capsule-shaped housing of a sensor.

FIG. 8 shows the interior area of a capsule-shaped housing 610 of a sensor 61, 62, 63, (FIG. 5), and FIG. 9 a section along the line IX—IX in FIG. 8. The housing 610 has a top part 611, preferably embodied to be flat, and an annular-shaped wall 612. In the interior, the housing 610 has four enlargements 613, 614, 615 and 616 (FIG. 8) with threaded holes for fastening a plate 617, which can be embodied as a print plate. The housing 610 is provided with a peripheral thickening 618, which acts in the manner of a toroidal magnifying glass or collecting lens for the incident laser beams 619, 620, because the housing material is transparent, or respectively light-conducting, to the laser beams used. Preferably three fastening elements 621, 622, 623 are arranged on the plate 617, which extend relatively far into the interior area of the housing and hold a printing plate 624 there, which supports several photosensors 625, 626, 627, 628 and a microprocessor 629 or, if desired, only a discriminator. The fastening elements 621, 622, 623 can simultaneously be used as electrical connections for supplying already discriminated signals via lines to the control unit 7 (FIG. 5). The battery voltage from the carrying strap 6 (FIG. 5) is preferably supplied via these contacts 621, 622, 623 (FIGS. 8, 9).

The photosensors 625, 625, . . . are arranged inside the housing in such a way that each of their sensitive sides lies flat against the inner, preferably cylindrical annular wall sections, which are located between the widenings 613, 614, 615 and 616, in order to detect the laser beams conducted through the thickening. At least one further photosensor 630 is located in the center of the print plate 624, whose sensitive side is directed toward the cover 611 of the housing and is therefore suitable for detecting laser beams 631, 632, which arrive with a greater inclination in respect to the surface of the bottom 611 than the laser beams 620 and 619, which are propagated almost parallel with this bottom surface.

In addition to the individual microprocessor 629 or 96 (FIG. 7) or discriminator, an individual pre-amplifier 92 and an integrator filter 95 are also preferably placed in the housing 610, in order to obtain as individual means an alternating electrical system from the received chopped laser beams and to supply the already discriminated signals via lines to the control unit 7. For example, the coil 93 and/or the capacitor 94 can be housed in the print plate 624 or can be integrated there which, as sensor means, constitute the resonance circuit. The discriminator and/or the microprocessor can be embodied for filtering only signals with an expected coding from the received laser beams.

A sensor in accordance with FIGS. 8 and 9 is therefore embodied in the shape of round disks with the diameter/thickness ratio to be found in the drawing figure. The incident laser beams can be reflected at the body of soldier B and can laterally reach the radiation-sensitive side of the photosensor 625 through the peripheral thickening 618 as laser beams 619 or 620 (FIG. 9). When using infrared laser beams, which are invisible to the human eye, the housing 610 can be opaque to normal light, for example colored or black.

The system device for illuminating the target therefore transmits a modulated lightbeam to the sensors of the harness of another soldier. The modulated lightbeam transmits information or a report in the form of a flexible protocol which, as a function of the required information, is coded as a data package of a length of, for example, 4 to 400 bits, but preferably up to 200 bits. For example, the friend-or-foe identification system can be based only on the transmission of preferably approximately 16 bits, while a friend-or-foe identification system with a simulation option could require 44 bits. The code is transmitted, depending on the number of bits to be transmitted, within 5 to 70 ms. The sensor interprets the code, which nominally is divided into zones for identifying the individual soldier (16 bits), for identifying the weapon used (4 bits), and for transmitting the exact position (96 bits for all three coordinates determined by a GPS receiver). The bit code can then be used for creating a highly encrypted code. The coded signal can consist of information for identifying a. the individual soldier b. a daily changing code c. the battalion code and d. the code of a synchronization from a mixture of a time-dependent and a special code. Therefore the communication system has a very large information bandwidth and is usable up to a transmission distance of approximately 11 km. The invention herein described can be preferably used at short distances approximately corresponding to the visibility of an individual soldier, but in general it is also used for the establishment of connections with soldiers which are farther away than the distance mentioned.

The present harness system can also be used as a combat simulation system. In this case a soldier using the system also aims his weapon at a target, i.e. a second soldier wearing a harness, and triggers the laser device by means of a shot. When the lightbeam hits the detectors on the harness of the second soldier, the first soldier receives a hit indication as the acknowledgement that he has made a hit.

Figure 11:
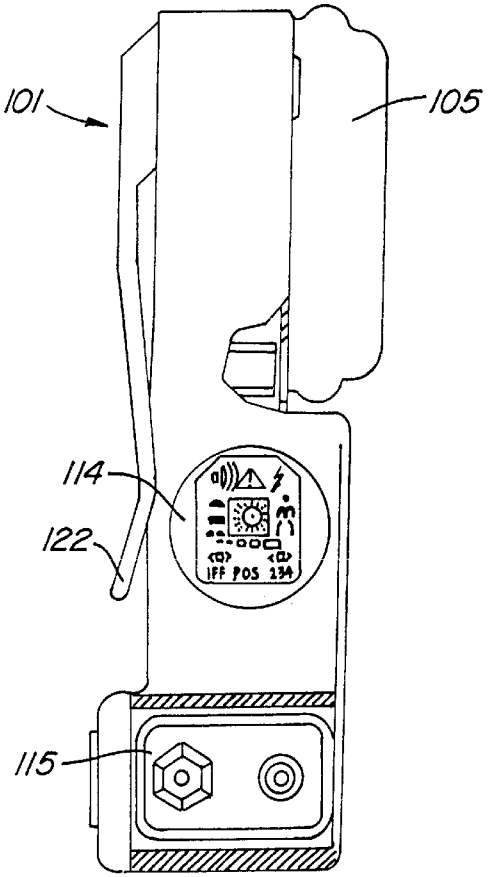
FIG. 11 represents an embodiment of the control unit in a lateral view.
Figure 10:
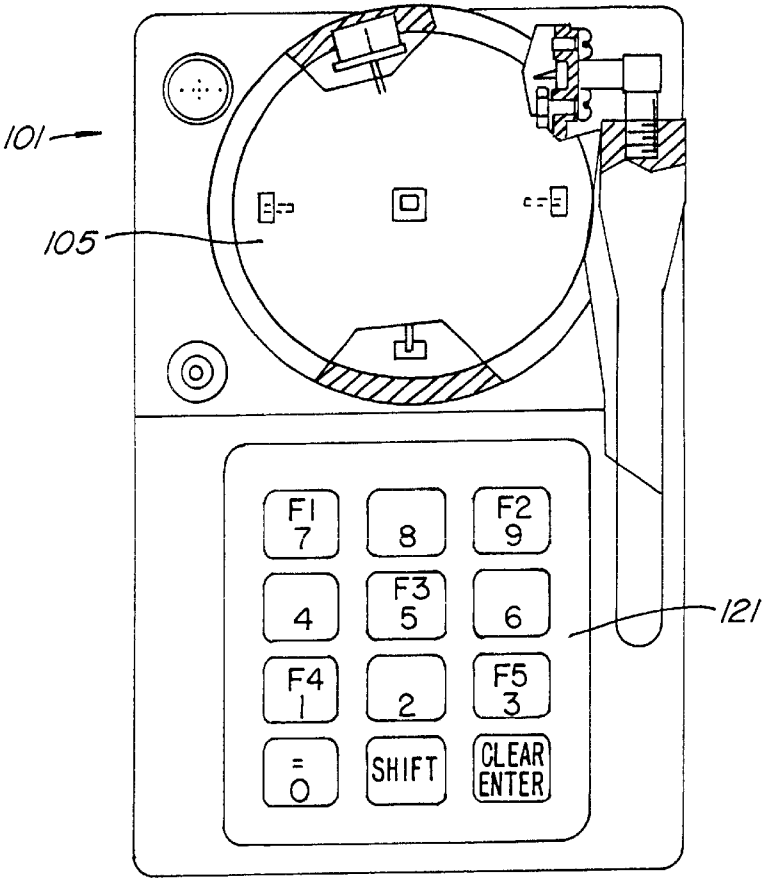
FIG. 10 represents an embodiment of a control unit in a front view.

FIGS. 10 and 11 show an exemplary embodiment of a control unit 101, which is also equipped with a light detector 105. It contains a keyboard 121, a display 114 and a battery 115. This unit can be fastened by means of a clamping strap 122 on a shirt pocket, a belt or other piece of equipment.

The data exchange between individual components of the harness system takes place via ultrasound signals or HF radio. To this end, one of the components, the control unit 101, operates as the controlling unit (master). The other units operate a controlled units (slave units).

Figure 12:
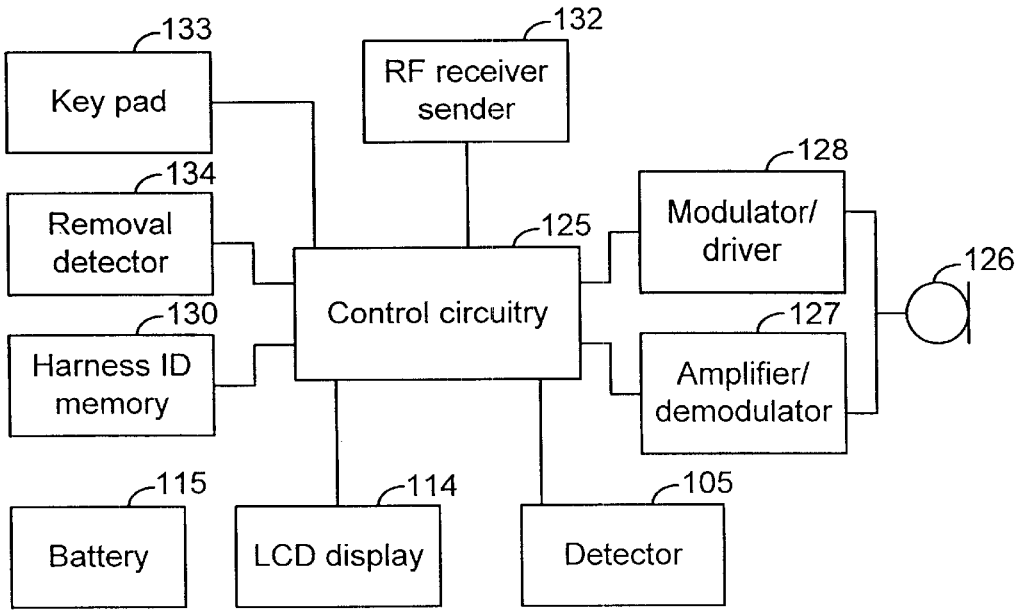
FIG. 12 is a block diagram of a controlling unit, FIG. 13 by way of example represents a data package which is exchanged between the components of the harness system.

FIG. 12 represents a block diagram of a controlling unit which, without the elements 132, 133 and 134, can also operate as a controlled unit of, for example, the helmet or harness system. The block diagrams of other controlled units, such as a GPS module, can contain other or additional elements.

The controlled unit is controlled by a control circuit or microprocessor 125 containing, for example, a microprocessor, RAM and ROM. The control circuit 125 monitors the signals from the light detector 105 and shows data on an LCD display 114. The elements of the controlled unit are supplied with current by a battery 115. A first ultrasound converter 126 is intended for data transmission and is, for example, a piezoelectric element, which can be operated both as a transmitter and a receiver of ultrasound waves, preferably at a frequency of 40 kHz. Signals coming from the first ultrasound converter 126 are processed in an amplifier/demodulator 127 and supplied to the control circuit 125. Signals which are transmitted by the controlled unit, are supplied to the transducer/converter 126 via a modulator/driver 128.

Transmitted and received signals can be coded in all ways known to one skilled in the art, namely preferably by amplitude, frequency or pulse modulation.

Each controlled unit also includes a memory unit 130 for storing an ID for each harness. THE ID is an individual identification code for each harness system. The memory unit 130 for the harness system ID can be a portion of the RAM of the control circuit 125. The ID can also be changed by means of the keyboard.

With the control unit 101 in accordance with FIG. 10, the control circuit 125 is additionally connected with a radio transmitter/receiver 132 for communicating with the outside, with a second keyboard 133 for data input and for controlling the function of the harness system, and with a contact detector 134 for determining the distance of the control unit 101 from its wearer; this detector can be equipped, for example, with sensors which detect humidity, temperature, pulse, the human voice or other parameters which infer the nearness of the body of its wearer, or contain mechanical detectors which indicate the opening of the mechanical devices used for fastening it to its wearer.

Figure 13:
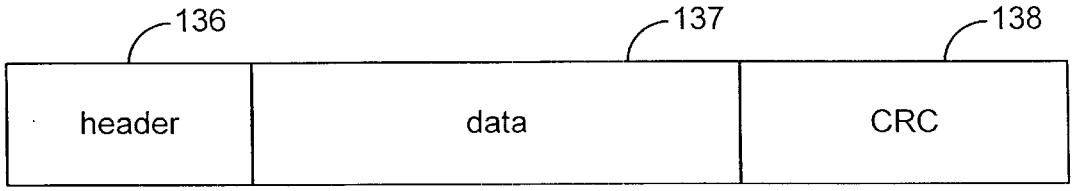

The data exchange between the individual components of the harness system can be performed, for example, by means of the use of data packages such as the one in FIG. 13. Each data package starts with a data head 136, which is followed by a data block 137 and a suitable control sum 138.

During normal data exchanges, standard messages with a data head 136, which contains the harness system ID of the respective harness system, are transmitted. After receipt of the message, each component compares this ID with the ID stored in the ID memory unit 130 of the harness system. If both identification codes match, the subsequent data block 137 is analyzed. The data block 137 contains for example information regarding the status of the detector(s) 105, messages to be represented on the LCD display, etc.

Such standard messages can be transmitted by each component of the harness system. They are received by all other components and are analyzed. The control unit 101 (125) can transmit control messages in addition. One of these control messages is the initialization message.

An initialization message is usually transmitted after the user has put on the harness system, has entered a harness system identification code to be stored in the harness system ID memory unit 130 and has operated an initialization key on the keyboard 133. The initialization message contains a special initialization code in the data head 136 (FIG. 13). When a controlled unit receives a message with this initialization code, it is run through the data block 137 containing the harness system ID of the control unit. This harness system ID is copied into harness system ID of the receiving controlled unit. The initialization message is therefore used to set the harness system IDs of all controlled units within the range of the first ultrasound converter 126 (FIG. 12). After putting on a harness system, the soldier must find a location which is sufficiently far away from the other users of the system and must actuate the initialization key on his control unit 101 (125) (FIG. 10). All components of his harness system are initialized by means of this and synchronized with the ID code.

The synchronization message is a second control message transmitted by the control unit. Synchronization messages are transmitted at regular time intervals. Each synchronization message contains a special synchronization code in its data head 136 (FIG. 13), as well as the harness system ID of the control unit in its data block. Each controlled unit checks whether at least one synchronization message with the harness system identification code had been received within a predetermined length of time. If not, this unit assumes to have been moved away from its control unit. It then starts a search for any arbitrary synchronization message and, if such a message has been found, takes the harness system ID of it from its data block 137 (FIG. 13) and sets its own harness system ID memory unit to this new harness system ID. This allows the interchange of harness system components. If a harness system component is transferred from one soldier to another, it will automatically adapt its identification code to the one of the harness system components in its immediate vicinity.

Normal standard messages are used for the data exchange between the components of the harness system. For example, they include information regarding:

1. the laser light signals received from one of the detectors 105 (FIG. 10),
2. the status of the batteries of the individual components,
3. the messages to be displayed on the LCD display 114 (FIG. 11) of each component, wherein each display 114 of each component displays the same information in connection with a preferred embodiment,
4. position information from a carried GPS unit,
5. information from the laser device regarding the status of the friend-or-foe identification or of the simulation. However, any arbitrary other information can also be exchanged.

In one embodiment the control unit 101 (FIG. 10) performs the control function, while all remaining components are controlled. But it is also possible to make any other arbitrary component the control unit. The number of components can also be greater or less than in the present example.

Figure 14:
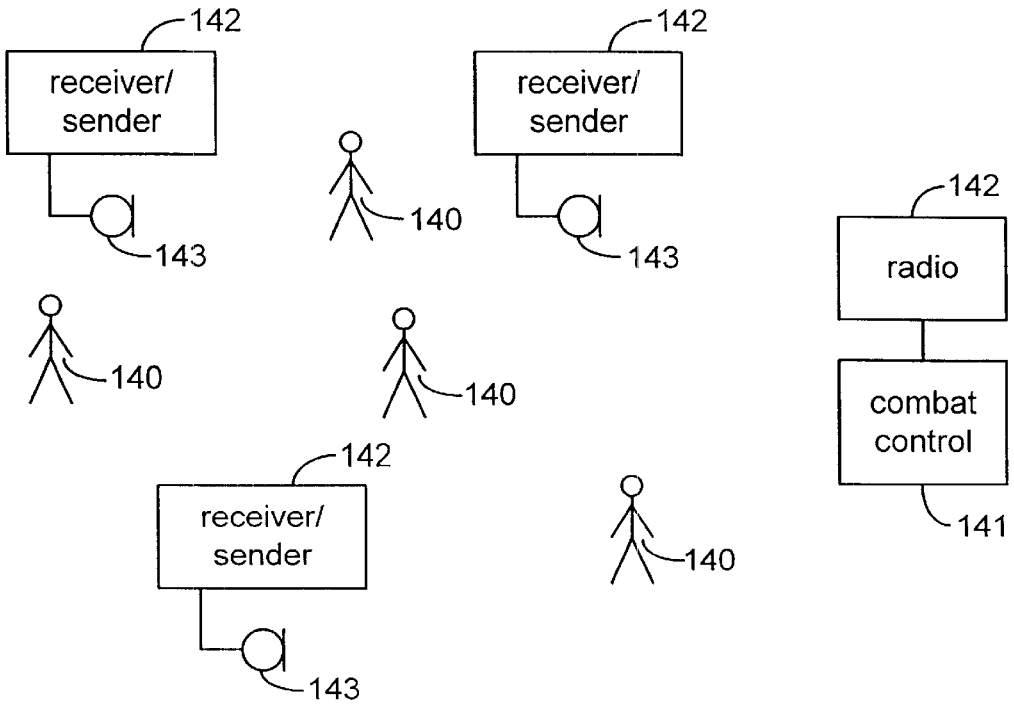
FIG. 14 shows a combat simulation or control system in a schematic representation.

FIG. 14 shows a complete combat or simulation system, such as is used for supervising or commanding a multitude of soldiers 140 from a command center 141. The command center 141 is equipped with a second radio transmitter/receiver 142, by means of which data connections with the radio transmitters/receivers 132 (FIG. 12) of the control units 101 (125) (FIG. 10) of the harness systems of the soldiers is assured. This connection is used by the control units for transmitting status reports from each soldier (such as his position, emergency calls, detected hits, etc.). The command center can use this connection for transmitting commands such as "retreat" or "attack".

Supplementing what was described above, a multitude of fixed or mobile (for example mounted on vehicles) second radio transmitters/receivers 142 can be provided, which are connected with the command center 141 by radio or cable. Each transmitter/receiver 142 contains one or several second ultrasound converters 143 which can be used for communicating with the first ultrasound converters 126 of the harness systems. Second transmitters/receivers 142 can, for example, detect the presence of soldiers in a given area (for example in a room), and in the process can detect further information for the command center. They can also be used for transmitting data from the command center 141 to all soldiers in a given area. The second radio transmitters/receivers 142 can also be connected with automatic door openers, room lighting, video monitoring installations, etc. It is not necessary for such functions to have a connection with the command center 141.

Communications possibilities of this kind among soldiers are of paramount importance both in training and also under real combat conditions. In particular, one-way or two-way communication between respectively two individuals is necessary for operating identification-friend-or-foe systems (IFF) and combat simulation systems.

Figure 15:
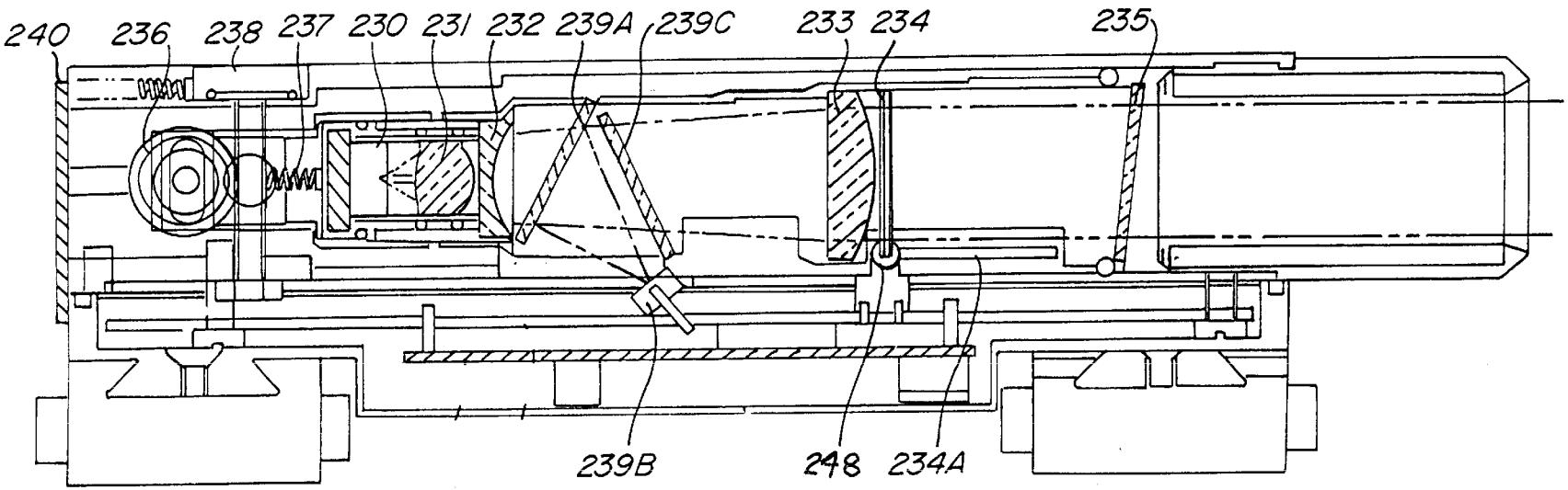
FIG. 15 represents a cross section of a laser light source in accordance with the invention.

The laser light source in accordance with FIG. 15 consists of a semiconductor laser 230, an optical device consisting of lenses 231 to 233, which collimate the lightbeam, a holographic grating 234 and an outlet window 235. The lenses, which are mass-produced, have been selected with a view as to their capability of creating a lightbeam with a divergence of 0.2 to 0.5 mrad. The holographic grating 234 is seated, rotatable around a hinge 248. Rotation is caused by means of a knob, not represented, attached to the outside of the housing. When this grating is moved into its horizontal position 234*a*, it does not affect the lightbeam. In its vertical position the divergence of the lightbeam is increased to 10 mrad.

A beam splitter 239*a* is inserted between the lenses 232 and 233 for guiding light emanating from the laser device into the detector 239*b*. A further plate 239*c*, which is arranged symmetrically in relation to the beam splitter 239*a*, compensates the offset of the light caused by the beam splitter 239*a*. The beam splitter 239*a* and the detector 239*b* are used to detect objects in the propagation path of the lightbeam. This can be dirt on the hinge 235 or other obstacles (for example a leaf) in the emanating lightbeam. Such objects reflect a portion of the laser light and therefore generate a signal in the detector 239*b* which can warn the user. The detector 239*b* can furthermore be used for receiving a response signal, such as is described in what follows.

The semiconductor laser 230 (FIG. 15) emits light of a wavelength of 820 nm with constant output (not pulsing), or of any arbitrary other wavelength, preferably in the range between 780 and 1000 nm, and has an output of 50 mW, for example. If the laser light source is operated together with the holographic grating 234, because of which the emerging lightbeam has a divergence of 10 mrad, the range is approximately 2 km, but without the holographic grating 234 more than 10 km, because of the divergence reduced to 0.2 mrad. At distances of less than 2 km the aiming process is made easier by the inserted holographic grating 234. The employment of a laser emitting in the near infrared range, i.e. at a wavelength of less than 1000 nm, provides several advantages: a semiconductor lasers emitting at these wavelength ranges can be operated to emit continuously. By means of this the emitted light can be precisely modulated in a simple manner (pulse code modulation/chopper), wherein the signal-to-noise ratio in the emanating lightbeam is improved, b. cross-overs with lasers used in distance-measuring equipment (with an emission wavelength of 1500 nm) are prevented. Devices for detecting the emissions of distance-measuring equipment are not accidentally triggered. It should, however, be noted, that the invention can also be realized by means of lasers (or other light sources) emitting on any arbitrary wavelength.

Figure 16:
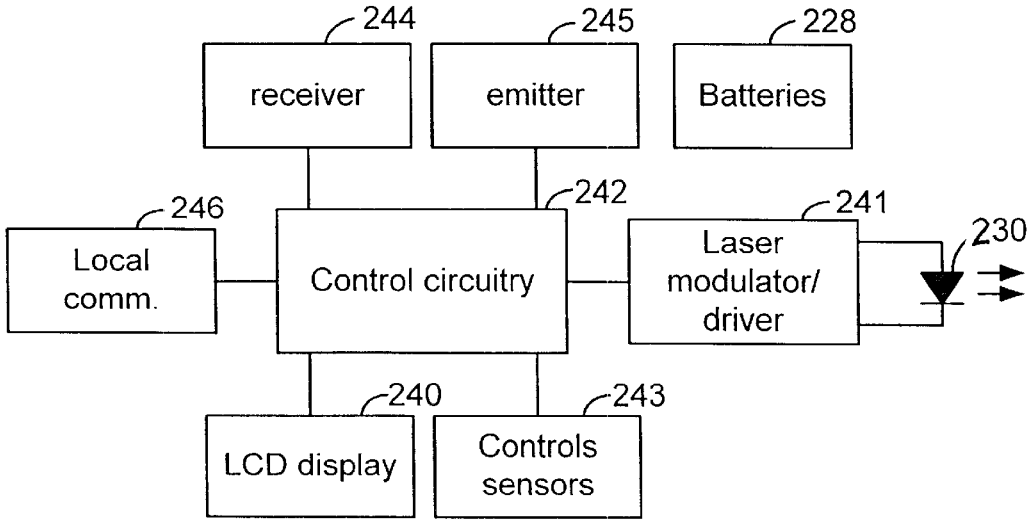
FIG. 16 is a block diagram of the electronic components in the laser device in a first embodiment of the present invention.

In accordance with FIG. 15, the semiconductor laser 230 can be aligned by means of adjusting screws 236 to 238. An LCD display 240 is disposed on the rear wall of the top of the housing. FIG. 16 represents a block diagram of the electronics integrated in the laser device 1 (FIG. 4) in a first, preferred embodiment. A control circuit 242 is represented in connection with an LCD display 240, control members and sensors 243 (including the lever and the detector 239*b*), a radio receiver/transmitter 244, 245, a modulator/amplifier 241 for a laser diode 230, and a local communications interface 246. All electronic circuits and devices are operated by means of batteries 228. The radio receiver/transmitter 244, 245 can transmit and receive digital signals and contains the modulation and demodulation circuits in accordance with the prior art required for this. The frequency, or respectively the radio channel of the transmitter and the receiver can be fixed by means of the control circuit 242. In the present embodiment, the receiver/transmitter 244, 245 can send and receive data on 32 different channels. The local communications interface 246 (FIG. 16) establishes and maintains the connection with the control unit, the arm harness and the helmet harness. The local communications interface 246 is equipped with suitable transmitters and receivers for infrared, ultrasound, induction, cable or radio communications for this purpose. Similar communications interfaces are located at the individual elements of the harnesses and in the control unit.

Each harness system component includes a harness, whose ends are releasably connected with each other, for example by means of a buckle or Velcro closures (not shown in detail for the sake of clarity). The harness supports one or several detectors, whose sensitivity has been matched to the light radiated by the laser device, and a control circuit. Each control circuit includes a local communications interface, similar to the local communications interface of the laser device. The user furthermore carries a control unit, which is also equipped with a light detector and a communications interface.

In the present embodiment, the user has separate harnesses on his arms and on the helmet, the control unit is separately fastened to his clothing. Because of this arrangement, putting the harness system on and taking it off can also be easily performed if the soldier carries a backpack or other equipment along. However, it is also possible to combine the two arm harnesses and the control unit into a single harness system. It is furthermore possible to add more detectors, for example by attaching them to the legs, but operations can also be maintained with fewer detectors and/or harness system components.

In the subsequent explanations, the equipment of the soldier which emits the laser lightbeam is identified by the term "interrogation unit"; the equipment of the soldier which receives the laser lightbeam has been designated "response unit". However, it should be stressed that in the present embodiment the equipment of each soldier contains all components of an interrogation unit and a response unit, i.e. each soldier can interrogate and also be interrogated.

Figure 17:
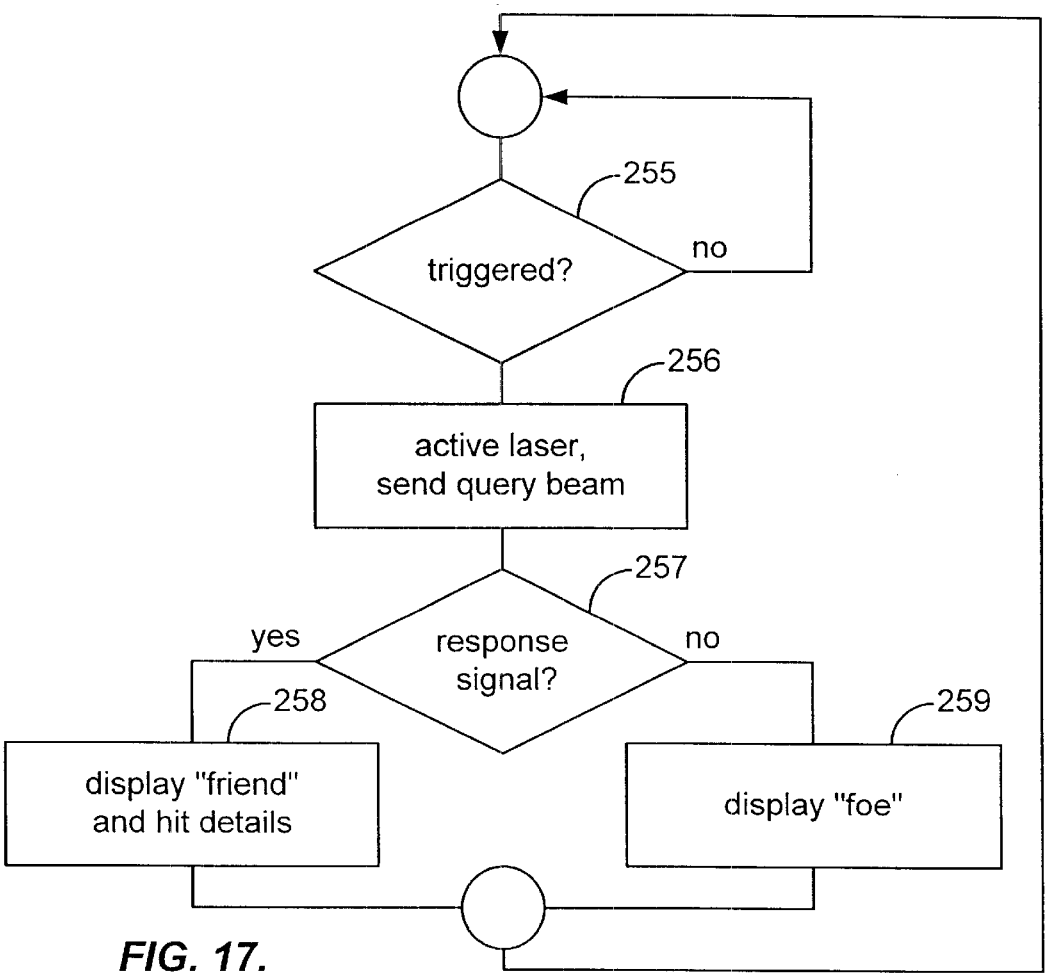
FIG. 17 is a flow diagram describing the interrogation process.

The present system can be used as identification-friend-or-foe, combat simulation or for aiming practice. The basic mode of functioning is the same in identification-friend-or foe and combat simulation. First, the soldier carrying the interrogation unit selects his potential target by an appropriate alignment of the laser device. Thereafter he operates the lever 47 (FIG. 2) by pushing it into its active on position. This operation is detected by the lever control circuit 47 (FIG. 2) of the laser device 1, which continuously scans the position of the lever, as represented in step 255 of the flow diagram in FIG. 17. As soon as a movement of the switching lever has been detected, the laser diode 230 (FIG. 15) is put into operation and a lightbeam, which is used for interrogation, is transmitted (decision step 256 (FIG. 17) in the flow diagram.)

The lightbeam used for interrogation or the interrogation signal are pulse-modified and contain a binary coded data package containing the following interrogation data:

1. a frequency code with the requested channel for transmitting the response,
2. an identification code of the interrogating unit,
3. a number designating the individual soldier (optional),
4. further data (option: security, or respectively control code).

The frequency code determines the requested channel for transmitting the response; i.e. the frequency of the high frequency carrier on which the transmission of the response of the response unit is expected. To determine a suitable frequency, the interrogation unit continuously monitors all available frequencies and keeps a list of the channels which are free at the moment. Prior to transmitting an interrogation signal, the interrogation unit selects one of these free channels as the channel to be monitored for the response.

The identification code contains the identification of the interrogator, for example an identification number expressly assigned to the equipment of the respective soldier, as well as guard information which permits the receiver to check the identity of the interrogator positively. Further data could contain, for example, the position of the interrogating unit, the type of firearm, etc.

If the aiming process performed by the soldier has been sufficiently accurate, the lightbeam used for interrogation will strike the response unit, in which it is detected by one of the detectors (for example 65 in FIG. 5).

Figure 18:
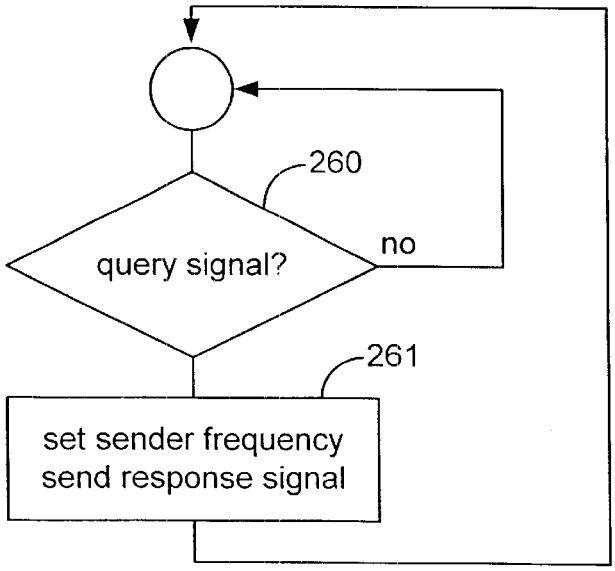
FIG. 18 is a flow diagram describing the response process.

The response unit continuously monitors the detectors connected to it in order to detect a lightbeam, as indicated in step 260 in FIG. 18. As soon as the response unit receives an interrogation signal, its identification code is checked and, if the identification is positive (i.e. when the interrogating unit has been determined to be authorized to interrogate the response unit), a response is prepared. The requested channel for transmitting the response is obtained from the interrogation signal, and the carrier frequency of the radio transmitter 245 (FIG. 16) is set accordingly and the appropriate response signal is transmitted by radio, as represented in step 261 (FIG. 18).

The response signal contains the following response data:

a. the identification code of the response unit, b. information regarding the sensor(s) struck by the interrogating lightbeam (optional), c. additional data (optional).

The identification code is again a verifiable code, which identifies the responding unit. The information regarding the sensor(s) which has/have detected the interrogation signal makes it clear which of the sensor(s) of the response unit has/have detected the signal. This information is particularly useful in combat simulations. Further data again can contain information regarding the position of the response unit, or other useful data, which could be useful during combat or during the simulation. This can also be information identifying the response unit.

When the response unit detects an interrogation signal, its user is not alerted, except in combat simulations, in which this signal can be used for indicating a hit. A soldier which has been hit is assumed to be dead or wounded. If the response unit has a plurality of detectors, for example on the chest, the arms and the head of the soldier, the response unit can also indicate the sensors which have been struck in order to convey a more accurate picture of the simulated damage.

In the meantime the interrogating unit monitors the selected channel for detecting a response (step 257 (FIG. 17)). Upon receipt of the response signal within a defined length of time after transmitting the interrogation signal, the identity of the responding unit is checked and, as long as the responding unit has been identified a friendly, the process is continued with step 258. The display 240 (FIG. 15) is triggered to show the interrogated unit to be "friendly". If not, the process is continued with step 259 (FIG. 17) and the interrogated unit is displayed as being an "enemy". In addition or alternatively to the display 240, it is also possible to represent the result of the identification-friend-or-foe by means of one or several LED's 41 (FIG. 2) or by means of an acoustic signal.

If the response unit receives a friendly response signal, it can transmit an acknowledgement signal by means of a laser lightbeam to the response unit. The dependability of the system is increased by this. If the acknowledgement signal is not received by the response unit, the response signal can be transmitted again. Although the use of such an acknowledgement signal is preferred, it is not required for the correct operation of the system, for this reason such steps are not indicated in FIGS. 17 and 18.

Since the amount of data required for the interrogation and response is comparatively short, the interrogation and response signals can be of very short duration. The response signal preferably has a length on the order of some milliseconds. However, without special steps being taken, a not inconsiderable possibility could arise that response signals of several struck response units are overlapped.

In order to prevent the collision of data packages in this case, a response unit does not respond immediately to an interrogation signal, but allows a preselected delay time to pass before putting its radio transmitter into operation. This delay time is determined by a random number generator, so that each response signal is transmitted at another time. Prior to transmitting the response signal, the response unit checks to determine whether the requested channel is occupied. An occupied channel causes a further random delay of the transmission of the response signal.

While FIG. 5 shows a soldier carrying a complete harness system including an interrogation unit and a response unit, it should also be added that some participants in combat or in a simulation can carry only a response unit or an interrogation unit. For example, civilians could be provided only with a response unit (FIGS. 10, 11).

The laser device of the system represented here can be used for identification-friend-or-foe, for combat simulation and for firing, as described above. In addition, it can be used as an aiming aid for the exact alignment of the weapon with a target, wherein the user must wear a night vision aid for detecting the aiming point illuminated by the near-infrared laser.

The laser lightbeam can also be used for distance measuring and communications. For communications purposes the control unit can be provided with a keyboard, for example, which permits the input of one or several messages, wherein a microphone, a loudspeaker and/or a video display can be provided. When applying the present system, in particular in a combat situation, it is possible to use a central, fixedly installed radio receiver for monitoring all signals transmitted by the response units, as well as the representation of all events and losses, in order to provide the combat control with an instrument for evaluating the situation.

In addition to the components already described, each harness system can be equipped with earphones, for example for transmitting a signal which indicates whether a predetermined target is shown to be friend or foe as a result of a corresponding interrogation.

When employing the system for identification-friend-or foe, a mechanism should be provided in the harness system which causes the irreversible shut-down of the system when it is removed from its original wearer. To this end the harness system can be equipped with sensors, for example, which detect values indicating the immediate proximity of a living human body. However, mechanical detectors, or so-called "speech detectors" (detectors reacting by speech displays), can be provided, which indicate the opening of harness closures, fastening of the control unit, etc. As soon as these sensors or detectors become aware that the harness system (or portions thereof have been removed from their original wearer, the functions of the harness system are disabled until a predetermined access code has been entered via the keyboard of the control unit.

With the embodiments represented so far, the response signal was an electromagnetic signal on radio frequencies. However, other forms of transmission can be selected for the response signal. In contrast to the embodiment represented in FIG. 16, in a further embodiment it is possible to employ a receiver designed for light, and a transmitter emitting light in place of the radio receiver/transmitter 244, 245 (FIG. 16) for communications between the interrogation and the response units. When a response unit receives the interrogation signal, it transmits the response signal, for example by means of pulse modulation, via the light-emitting transmitter 245. The light-emitting transmitter 245 can consist of one or several LEDs or other light sources, which transmit light over a wide angle and which can be attached anywhere on the response unit, for example on the helmet harness or in each light detector. The receiver 244 designed for light preferably contains a detector 239*b* (see FIG. 15). When the laser device 1 is aimed at the response unit, the lens 233 forms an optical imaging device, which represents the response unit on the detector 239*b*, so that the reception of the signals of the transmitters 245 is made possible.

In accordance with a further embodiment of the invention, one or several ultrasound transmitters 245 (FIG. 16), as well as an ultrasound receiver 244, can be used for communications between the interrogation and the response units. When a response unit receives an interrogation signal, the ultrasound transmitter 245 is used for transmitting the response signal, for example by pulse modulation at a frequency of 40 kHz. The ultrasound transmitter 245 can be attached to any arbitrary location of the response unit. The ultra-sound receiver 244 preferably is directionally sensitive and can be attached to the laser device 4 (FIG. 4), for example, instead of the antenna. It receives and demodulates the signal of the response unit generated by the ultrasound transmitter 245.

In these embodiments the response signal can also be transmitted on a carrier frequency. Here, the carrier frequency can be the frequency of a periodic modulation of the individual pulses from the light-emitting transmitters 245. The carrier frequency to be requested can be determined by the receiver 244 of the interrogation unit prior to the interrogation signal being transmitted, and can then be transmitted to the response unit in the frequency code of the interrogation signal which had been described in connection with the first embodiment. The receiver 244 of the interrogation unit is provided with suitable filters for the selective reception of a response signal on the carrier frequency given. Again, overlappings of competing communications processes are prevented by this.

Figure 19:
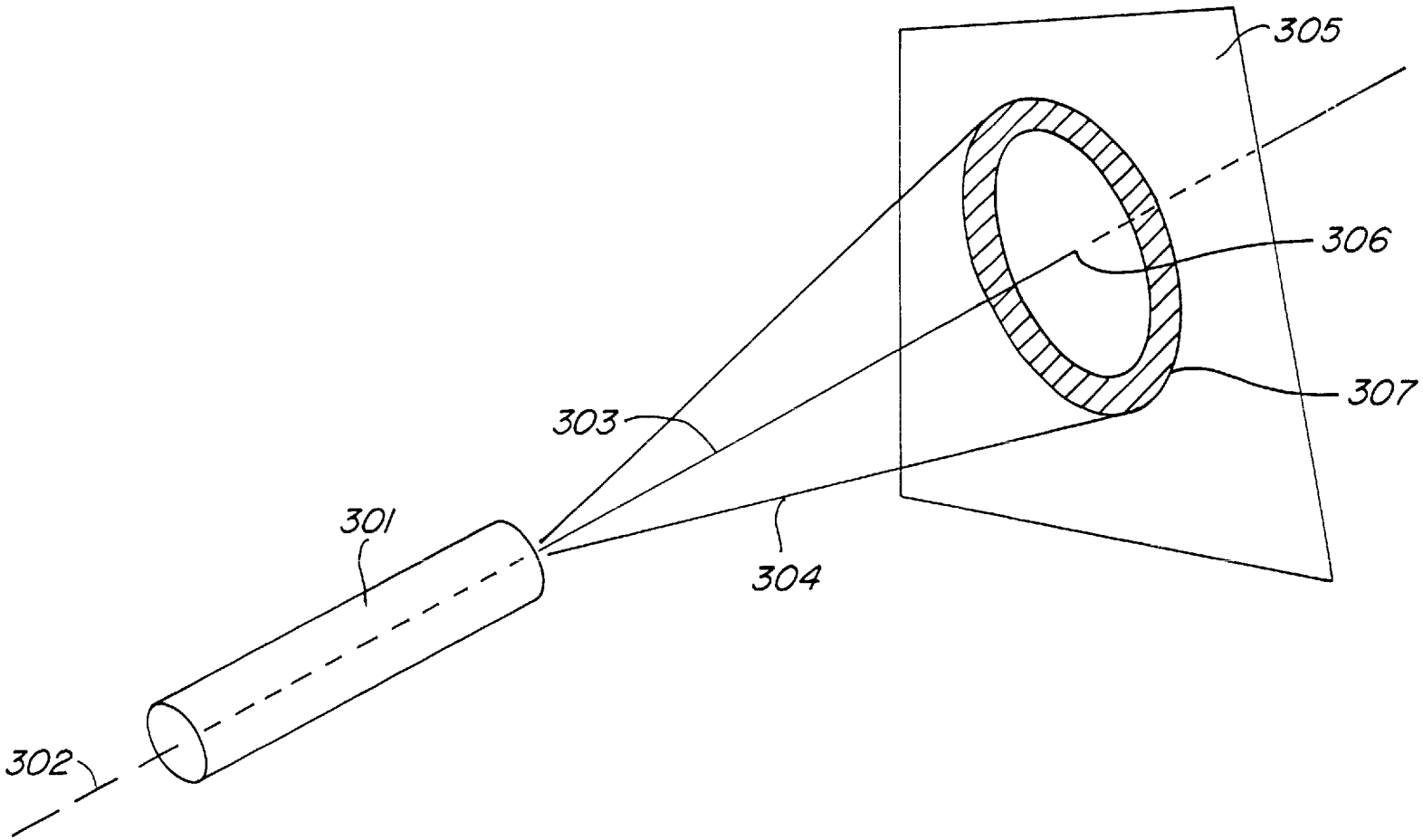
FIG. 19 is a schematic representation of the mode of operation of the target device in accordance with the invention.

The aiming device 301 in accordance with FIG. 19 has an axis 302, which is adjusted parallel with the firing axis of a weapon, for example. For one, it generates a bundled lightbeam 303, which is propagated along the axis 302. At the same time the aiming device can also generate a diverging light cone 304. This cone has an opening angle of approximately 10 mrad, for example, and has the axis 302 as an axis of symmetry.

The bundled beam 303 generates a light spot 306 on a target object 305, which marks the intersection of the axis 302 with the target level. If the weapon and the aiming device 1 FIG. 2) are correctly adjusted in respect to each other, the light spot 306 essentially corresponds to the impact point. The light cone 304 forms an illuminated ring 307 around the light spot 306. This permits the user to bring closer targets more easily into congruence with the axis 303, since the spot size of an undiffracted lightbeam is only a few millimeters at short distances.

Figure 20:
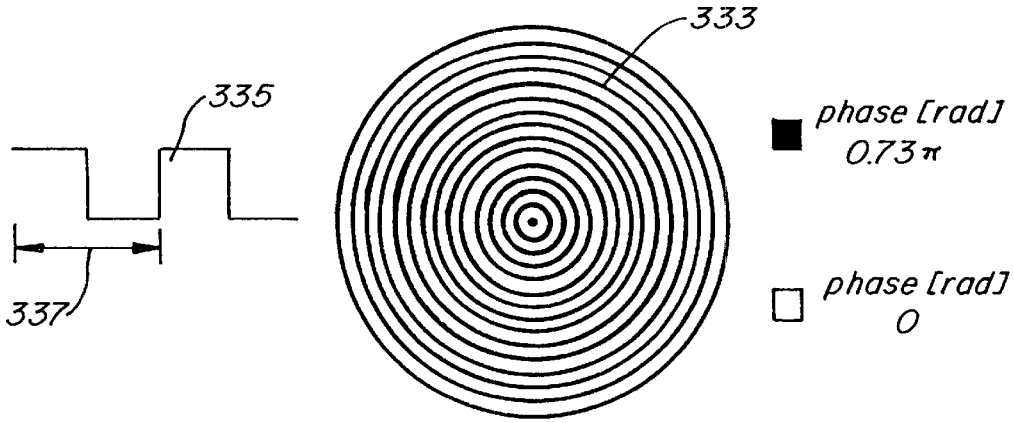
FIG. 20 is a schematic representation of a holographic phase grating.

As can be seen from FIG. 20, the grating in the present exemplary embodiment is designed in such a way, that the phase of the originally level lightwave suddenly increases by 0.73 p in the respective ring-shaped zones, because of which approximately 20% of the light output remain in the undiffracted beam. By affecting the electrical field in an appropriate grating, the amount of the sudden phase changes becomes adjustable, by which the distribution of the light output between the diffracted and undiffracted lightbeams can be adjusted continuously and without the use of mechanical means.

A further embodiment consists of a holographic grid with a variation of optical damping instead of the phase of the light field, wherein this should be done with suitable means, for example liquid crystal cells.

Figure 21:
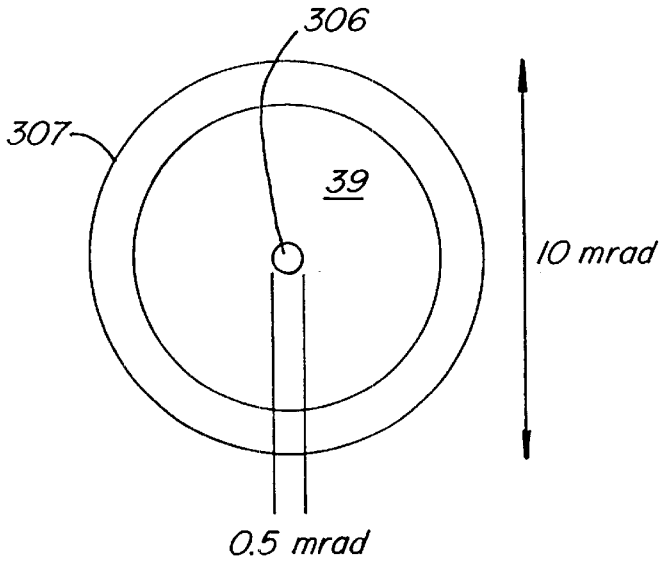
FIG. 21 shows the illumination and marking of a target by means of the targeting aid in accordance with the invention.

A projection of the undiffracted and the diffracted light on a vertical plane is represented in FIG. 21. Here, the light spot 306 has a divergence of 0.5 mrad, which is proportional to the size of the projection, and which is 10 mrad in the ring 307 generated by diffraction in the holographic grating. Here the strength of the ring approximately corresponds to the said wall thickness of the light cone 304 and therefore to the diameter of the light spot 306. By means of an appropriate design of the holographic phase grating and depending on the purpose of use, even illumination of an area between the ring 307 and the light spot 306 is additionally provided which, depending on the requirements, also extends outside of the ring 307. The position of the center of the circle 307 in the target plane is critical in respect to the vertical incidence of the lightbeam in the holographic phase grating, but a displacement of the grating vertically in respect to the optical axis only causes uneven strength of the ring 307.

Since in the laterally pivoted out positions of the holder of the light source a portion of the light output is required for generating the illumination cone 304 (FIG. 19), the total light output transmitted by the aiming device in this positions should preferably be greater than in the centered position of the holder. To this end it is possible, for example, to provide a position sensor on the holder which increases the light output of the light source 301 if its light is routed through one of the optical deflection devices.

The described aiming device is suitable for all types of use, but in particular also in combination with other optoelectronic aid systems. For example, the beam emitted from the light source can be modulated in time and provided with information, or respectively identification, signals, which are then aimed an diffusedly transmitted.

The laser device can emit invisible or visible, preferably colored light and can contain means for making it possible, when desired with the aid of a switching system which is operated from the outside, for example knobs and/or levers, to switch one or several holographic gratings 234 (FIG. 15) in and out of the laser beam path, wherein such a grating can increase the divergence of the laser beam and result in an illuminated zone in the shape of a ring 307 (FIG. 19), or a triangle, or a square, or of several spots, or any other arbitrary shape.

The laser device can also otherwise comprise means for transmitting an invisible or visible laser beam, as desired.

The laser device can also be designed for transmitting tightly bundled laser beams which are only visible through night vision goggles, and can have means for alternatingly switch the laser beam (11) on and off as an alert message, so that a first soldier, who is equipped with night vision goggles and illuminates a second soldier, can identify the latter as friendly by means of this intermittent alert sign.

The identification system can also include code management in order to make possible the identification of aircraft, tanks, civilians, equipment, or respectively persons of the Red Cross, etc., and/or vice versa.

The control unit 101 (FIG. 10) can be programmed in such a way that upon the input of a special code the soldiers in a group can only identify soldiers of their own group, or that no identification at all is possible, or that groups can also be combined.

The identification system in accordance with the invention with at least one laser device for identifying at least one target device can also be embodied in such a way that the laser device transmits a coded laser beam, that the target device has sensor means for detecting this laser beam and converting it into electrical signals, which are supplied to a discriminator, and also includes transmitting means in order to return reports in accordance with decisions made in the discriminator to receiver means located inside or outside of the laser device, and that the laser device is designed for transmitting invisible or visible light, preferably colored light and contains means to switch one or several holographic gratings 234 (FIG. 15) into and out of the laser beam path, as desired, with the aid of a switching system which can be operated from the outside, for example knobs and/or levers, wherein such a grating increases the divergence of the laser beam and results in an illuminated zone in the shape of a ring 307 (FIG. 19), or a triangle, or a square, or of several spots, or any other arbitrary shape, and/or that the laser device includes means for transmitting an invisible or visible laser beam, as desired.

The laser beam used for identification can preferably be coded and/or chopped in such a way that the object to be identified is advised in which manner or on which channel or on which frequency band sequence a response is to be returned. This results in the great advantage that the laser path makes it impossible to spy out the frequencies, since nobody can know on which frequency or frequency band a response is expected. In addition, the laser beam can be bundled in such a way that objects in a group can be individually identified. The laser beam can furthermore also be used for sending information in speech and video images.

A multifunctional system for a multitude of different applications is disclosed by the invention:

simulated combat with reciprocity, identification in the simulation, with additional protocol capabilities, so that it can be exactly determined at the end of an exercise whether friends or only enemies have been hit by means of the laser, aiming laser with or without night vision goggles, detection of the positions of humans or objects in enclosed spaces and also in the open, with ultrasound in enclosed spaces and with ultrasound and GPS in the open, event reporting on-line by means of radio and the spatial position data, use of the laser for remote triggering of explosive devices and security installations, hitting video images with the laser, with subsequent detection of the position data of the light spot with an LCD camera or with a position sensor, firing for training purposes on an electronic target with on-line evaluation and protocol on any arbitrary PC, simulating an actual shot with a laser which has a very accurate beam characteristic almost identical to a bullet, with or without taking the ballistic trajectory into consideration, training in the same way as fighting, and fighting in the same way as training.

The same device can be used for short range weapons as well as for tanks and aircraft or ballistic weapons.

What is claimed is:

1. An identification system comprising:

a laser device which is capable of emitting a laser beam with a first code and a laser beam with a different second code;

a target device having a sensor for detecting said first and second coded laser beams from said laser device, a microprocessor for formulating a response, a laser response transmitter and a radio frequency or ultrasound response transmitter; and, receivers associated with said laser device which are collectively capable of receiving a laser response and either a radio frequency or ultrasound response from said target device;

wherein said laser device initially emits said laser beam with a first code to said target device to solicit a laser response and, if said laser device does not receive a laser response from said target device within a predetermined period of time after transmission, said laser device then emits said laser beam with a second code to solicit either a radio frequency or ultrasound response.

2. The identification system in accordance with claim 1, wherein said laser device transmits invisible or visible light and contains means to switch one or several holographic gratings into and out of the laser beam path with the aid of a switching system operated from the outside wherein such grating increases the divergence of the laser beam and results in an illuminated zone in the shape of a ring, a triangle, a square, or of several spots.

3. An identification system comprising:

a laser device which is capable of emitting a tightly bundled laser beam with a first code and a tightly bundled laser beam with a different second code which are both visible only through night vision goggles;

a target device having a sensor for detecting said first and second coded laser beams from said laser device, a microprocessor for formulating a response, a laser response transmitter and a radio frequency or ultrasound response transmitter;

receivers associated with said laser device which are collectively capable of receiving a laser response and either a radio frequency or ultrasound response from said target device; and, an alert device associated with said laser device which can alert the user of said laser device whether the user of said target device is friendly or not, wherein said laser device initially emits said laser beam with a first code to said target device to solicit a laser response and, if said laser device does not receive a laser response from said target device within a predetermined period of time after transmission, said laser device then emits said laser beam with a second code to solicit either a radio frequency or ultrasound response.

4. An identification system comprising:

a laser device having a laser target illuminating device, a housing element with batteries and a mounting rail for connecting the laser device elements together wherein said laser device is capable of emitting a laser beam with a first code and a laser beam with a different second code;

a target device having a sensor for detecting said first and second coded laser beams from said laser device, a microprocessor for formulating a response, a laser response transmitter and a radio frequency or ultrasound response transmitter;

receivers associated with said laser device which are collectively capable of receiving a laser response and either a radio frequency or ultrasound response from said target device; and, parallel extending, partially cylindrical parts on said laser device that a laser device user can use to aim along a gap between said parts and see an alert light between said parts for identifiing whether the user of said target device is friendly or not, wherein said laser device initially emits said laser beam with a first code to said target device to solicit a laser response and, if said laser device does not receive a laser response from said target device within a predetermined period of time after transmission, said laser device then emits said laser beam with a second code to solicit either a radio frequency or ultrasound response.

5. The identification system in accordance with claim 1, further comprising code management means associated with said laser device in order to make possible the identification of friendly aircraft, tanks, civilians, equipment, or soldiers.

6. A target device for an identification system comprising a portable harness device having a laser transmitter, light detector and regulating unit, wherein said regulating unit has a memory for storing a harness system identification code, a display, a battery, a keyboard capable of data input and preparing messages, and a control circuit for transmitting both said identification code and any messages by way of radio signals, ultrasound signals, light signals or cable.

7. The target device in accordance with claim 6, wherein said regulating unit may act as a control unit or a controlled unit wherein controlled units have a memory unit for storing the identification code from a control unit, as well as a control circuit for comparing incoming messages with the identification code stored in said memory.

8. The target device in accordance with claim 6, wherein means are provided for using a laser lightbeam from said laser transmitter for distance measuring or communication.

9. The target device in accordance with claim 6, wherein said regulating unit is programmed in such a way that soldiers of a group using said target device can only identify soldiers of their own group using the same said target device.

10. The target device in accordance with claim 6, wherein means are provided for detecting the distance of the regulating unit from its wearer by humidity, temperature, pulse, the human voice or other parameters which infer the nearness of the body of its wearer.

11. The target device in accordance with claim 6, further comprising a chopper means, a pre-amplifier and a discriminator.

12. An identification system in accordance with claim 1, wherein said laser beams are coded and/or chopped in such a way that the object to be identified is advised on which channel or in what frequency sequence a response is to be transmitted.

13. An identification system in accordance with claim 12, wherein said laser device is used for simulating a shot.

14. An identification system in accordance with claim 12, wherein said laser device can be used for both military training and fighting.

* * * * *